US009403203B2

(12) United States Patent
Hosoi

(10) Patent No.: US 9,403,203 B2
(45) Date of Patent: Aug. 2, 2016

(54) DIAMETER-REDUCTION APPARATUS FOR CAN-TRUNK, CAN-BODY HOLDER, CAN-MANUFACTURING APPARATUS, AND DIAMETER-REDUCTION METHOD FOR CAN-BODY

(71) Applicant: Universal Can Corporation, Tokyo (JP)

(72) Inventor: Masahiro Hosoi, Sunto-gun (JP)

(73) Assignee: Universal Can Corporation, Tokyo (JP)

( * ) Notice: Subject to any disclaimer, the term of this patent is extended or adjusted under 35 U.S.C. 154(b) by 128 days.

(21) Appl. No.: 14/370,293

(22) PCT Filed: Feb. 5, 2013

(86) PCT No.: PCT/JP2013/052619

§ 371 (c)(1),
(2) Date: Jul. 2, 2014

(87) PCT Pub. No.: WO2013/118727

PCT Pub. Date: Aug. 15, 2013

(65) Prior Publication Data

US 2014/0366605 A1 Dec. 18, 2014

(30) Foreign Application Priority Data

Feb. 7, 2012 (JP) ..... 2012-023950

(51) Int. Cl.
*B21D 51/26* (2006.01)

(52) U.S. Cl.
CPC ..... *B21D 51/2669* (2013.01); *B21D 51/2638* (2013.01)

(58) Field of Classification Search
CPC ..... B21D 22/26; B21D 22/30; B21D 51/26; B21D 51/2638; B21D 51/2646
USPC ..... 72/370.25; 413/76
See application file for complete search history.

(56) References Cited

U.S. PATENT DOCUMENTS 2,139,682 A * 12/1938 Hothersall ..... B21D 51/2646 29/DIG. 33
2,791,349 A * 5/1957 Morand ..... B21D 51/26 220/274

(Continued)

FOREIGN PATENT DOCUMENTS

JP 60-261631 A 12/1985
JP 08-010881 A 1/1996

(Continued)

OTHER PUBLICATIONS

International Search Report dated May 14, 2013, issued for PCT/JP2013/052619.

*Primary Examiner* — Teresa M Ekiert
(74) *Attorney, Agent, or Firm* — Locke Lord LLP

(57) ABSTRACT

A diameter-reduction apparatus for can-trunk for performing a diameter-reduction process on a trunk part of a can-body having a closed-end cylindrical shape with an open end, including: a can-body holder holding a bottom part of the can-body, which is provided with: a base pad abutting on the bottom part of the can-boy; and a first clamping-ring having substantially a cylindrical shape which clamps an outer circumference surface of a trunk part of the can-body at the bottom side and which moves back and forth relative to the base pad along a can-axis direction; a die unit for diameter-reduction provided with a die for a diameter-reduction process of the trunk part by moving back and forth with respect to the can-body holder along the can-axis direction; and a first clamping-ring moving device moving the first clamping-ring backward along the can-axis direction along with an advance of the die.

8 Claims, 18 Drawing Sheets

(56) References Cited

U.S. PATENT DOCUMENTS

| | | | | |
|---|---|---|---|---|
| 3,327,513 | A * | 6/1967 | Hinshaw | B21C 1/24 72/274 |
| 7,895,875 | B2 * | 3/2011 | Dickson | B21C 5/00 72/370.02 |

FOREIGN PATENT DOCUMENTS

| | | | |
|---|---|---|---|
| JP | 2003-200235 | A | 7/2003 |
| JP | 2003-305523 | A | 10/2003 |
| JP | 2004-188423 | A | 7/2004 |
| JP | 2009-012047 | A | 1/2009 |

* cited by examiner

DIAMETER-REDUCTION APPARATUS FOR CAN-TRUNK, CAN-BODY HOLDER, CAN-MANUFACTURING APPARATUS, AND DIAMETER-REDUCTION METHOD FOR CAN-BODY

TECHNICAL FIELD

The present invention relates to a diameter-reduction apparatus for a can-trunk, a can-body holder, a can-manufacturing apparatus, and a diameter-reduction method for a can-body for performing a process of drawing a metal-can-body in a can-manufacturing process for a beverage-can packing soft drink, beer or the like therein.

Priority is claimed on Japanese Patent Application No. 2012-23950, filed Feb. 7, 2012, the content of which is incorporated herein by reference.

BACKGROUND ART

A bottle-can for beverage made of aluminum alloy material is made by, for example, forming a plate material punched into a circular shape into a dosed-end cylindrical shape by performing a drawing process, an ironing process and the like, and further performing a diameter-reduction process.

Patent Document 1 (PTL 1) describes a can manufacturing apparatus for performing a diameter-reduction process to a closed-end cylindrical can-body. This can manufacturing apparatus has a structure which reduces a diameter of a can-body by advancing diameter-reduction position of the drawing die near to the base pad by providing a guide ring on the drawing die for preventing a can-trunk from swelling out so as to move back respect to the drawing die.

Patent Document 2 (PTL 2) describes a manufacturing method and a manufacturing apparatus which reduces a diameter of a can-trunk by drawing. In this case, by repeating the diameter-reduction processes in steps with holding the can along an axis direction, it is possible to form a can having a shape of reducing diameter thereof toward a bottom side or an opening side.

CITATION LIST

Patent Literature

[PTL 1] Japanese Unexamined Patent Application, First Publication No. 2003-200235

[PTL 2] Japanese Unexamined Patent Application, First Publication No, 2004-188423

SUMMARY OF INVENTION

Technical Problem

In such a forming process of a bottle-can, it is required to enlarge a deformation dimension in one process such as long deformation along the can-axis or large deformation of the diameter. However, in order to enlarge the deformation dimension in one process, an indentation load (what is called a neck-forming load) for pushing the can-trunk into the drawing die is increased, so that a can-bottom may sink or the can-trunk may swell out.

In recently years, it is required to work in a nearer part to the can-bottom than before in order to form a variant-can having a shape with steps of reduced-diameter parts and expanded-diameter parts from the can-bottom to the opening part.

If the reduced-diameter part is formed in the vicinity of the can-bottom using the apparatus of PTL 1, according to the structure in which the guide ring is further receded by abutting on the base pad, the reduced-diameter part can be near to the bottom part. However, because the guide ring is provided between the base pad and the drawing die, the reduced-diameter part is away from the bottom part at a length of the guide ring. In order to bring the reduced-diameter part closer to the bottom part in this structure, it is necessary to shorten the length of the guide ring. On the other hand, if the length of the guide ring is too small, t is difficult to prevent the can-trunk from swelling and the like. Furthermore, because the guide ring and the drawing die are separated, the can-trunk is not clamped at a part between the guide ring and the drawing die, so that the can-body may swell.

When the apparatus of PTL 2 is used, a flange is formed on an opening part previous to a forming process of a can-trunk, although a diameter cannot be expanded after forming the flange; so that, the design is restricted. That is to say, because the can in which the flange is formed is held between the opening part and the bottom thereof along the axis, it is not possible to expand the diameter. Accordingly, the opening part has the smallest diameter in a part formed from the opening side; and the bottom part has the smallest diameter in a part formed from the bottom side. Therefore, it is not possible to manufacture the variant-can having a narrow part at a middle part.

The present invention is achieved in consideration of the above circumstances, and has an object to provide a variant-can having a narrow part in the vicinity of a bottom part by performing a diameter-reduction process to the vicinity of the bottom part for a trunk part of a can-body made of metal.

Solution to Problem

The present invention is a diameter-reduction apparatus for can-trunk for performing a diameter-reduction process on a trunk part of a can-body having a closed-end cylindrical shape with an open end, including: a can-body holder holding a bottom part of the can-body, which is provided with: a base pad abutting on the bottom part of the can-boy; and a first clamping-ring having substantially a cylindrical shape which clamps an outer circumference surface of a trunk part of the can-body at the bottom side and which moves back and forth relative to the base pad along a can-axis direction; a die unit for diameter-reduction provided with a die for a diameter-reduction process of the trunk part by moving back and forth with respect to the can-body holder along the can-axis direction; and a first clamping-ring moving device moving the first clamping-ring backward along the can-axis direction along with an advance of the die.

According to the diameter-reduction apparatus for can-trunk, along with the advance of the die, the first clamping-ring clamping the outer circumference surface of the trunk part of the can-body is retreated with respect to the base pad, so that the die can approach the bottom part of the can-body with clamping the outer circumference surface of the trunk part of the can-body; accordingly, the diameter-reduction can be performed to far as the vicinity of the bottom part. On the other hand, when processing the trunk part at the opening side than the first clamping-ring, the first clamping-ring is not moved and clamps the trunk part of the can-body at the bottom side so as to prevent elastic deformation by the process. Therefore, the thickness is prevented from being uneven caused by anisotropic of rolled material in the process of diameter-deformation.

In the diameter-reduction apparatus for can-trunk, it is preferable that: the first clamping-ring moving device have: a push-back device moving back the first clamping-ring by pushing back the first clamping-ring along with approach of the die with respect to the can-body holder; and a returning device returning the first clamping-ring to a position before moving back. Furthermore, it is preferable that the push-back device include a contact part which is provided on the die unit and abuts on a op end of the first clamping-ring.

In this case, by connecting the approach of the die with the retreat of the first clamping-ring physically, the die can be reliably moved to the vicinity of the bottom part.

In the diameter-reduction apparatus for can-trunk, it is preferable that the push-back device be a second clamping-ring which has substantially a cylindrical shape, is provided on the die unit, is protruded forward from the die toward the can-body holder, and clamps an outer circumference surface of the trunk part at an opening side; and a top end of the second clamping-ring be the contact part which abuts on the top end of the first clamping-ring. In this case, because the second clamping-ring is disposed in the vicinity of the die, the trunk part in the vicinity of the die can be effectively prevented from swelling.

In the diameter-reduction apparatus for can-trunk, it is preferable that the returning device be provided with an elastic member which is provided on the can-body holder and energizes toward the base pad. In this case, the first clamping-ring can be easily moved forward along with the retreat of the die unit after retreat by being pushed back by the contact part of the die unit when the can-body is formed.

In the diameter-reduction apparatus for can-trunk, the first clamping-ring moving device may have: a drive device which moves the first clamping-ring back and forth; and a control device which controls the drive device. In this case, for example, by using a sensor detecting a position of the die, an actuator and the like, the first clamping-ring can be timely moved back and forth without contacting the die to the first clamping-ring.

The present invention is a can-body holder holding a can-body having, closed-end cylindrical shape in which one end is open, including: a base pad which abuts on a bottom part of the can-body; and a clamping ring having substantially a cylindrical shape, which clamps an outer circumference surface of the trunk part at the bottom side of the can-body and moves back and forth relative to the base pad along a can-axis direction.

The present invention is a can-manufacturing apparatus processing a can-body having a closed-end cylindrical shape in which one end is open, including: a plurality of the can-body holders; at least one processing-die unit which forms a trunk part of the can-body by advancing and retreating along the can-axis direction with respect to the can-body holder; and a can-body holder moving device moving the can-body holder intermittently with respect to the processing-die unit, in which one or more of the processing-die unit is a diameter-reduction die unit for diameter-reduction process of the trunk part of the can-body.

In the can-manufacturing apparatus, it is preferable that a plurality of the processing-die units be provided; and one or more of the processing-die unit be a diameter-expansion die unit which expands a diameter of the trunk part of the can-body.

The present invention is a diameter-reduction method for a trunk part of a can-body having a closed-end cylindrical shape in which one end is open, having the steps of: clamping an outer circumference surface of a trunk part of a can-body at a bottom side using substantially a cylindrical clamping ring and holding a bottom part of the can-body; and moving back the clamping ring and press-fitting a die for diameter-reduction of the trunk part into the trunk part of the can-body by advancing from an opening part toward the bottom part of the can-body, so that a top end of the die reaches in a vicinity of the bottom part of the can-body and a diameter-reduction is processed on the trunk part from the opening part to the vicinity of the bottom part.

Advantageous Effects of Invention

According to the present invention, it is possible to provide a variant-can having a narrow part in the vicinity of a bottom part by performing a diameter-reduction process up to the vicinity of the bottom part on a trunk part of a can-body made of metal.

DESCRIPTION OF EMBODIMENTS

Below, an embodiment of a can-body holder, a diameter-reduction apparatus for can-trunk and a can-manufacturing apparatus according to the present invention will be explained referring to drawings. A diameter-reduction apparatus 10 for can-body of the present embodiment is provided with a can-body holder 20 according to the present invention and performs a diameter-reduction on a trunk part 102 of a can-body 100 having a closed-end cylindrical shape with an open end. It can be utilized for so-railed a DI-can, a 3-piece can in which a bottom part is wound and closed, an impact-can or the like as the closed-end cylindrical shape with one open end.

Figure 1:
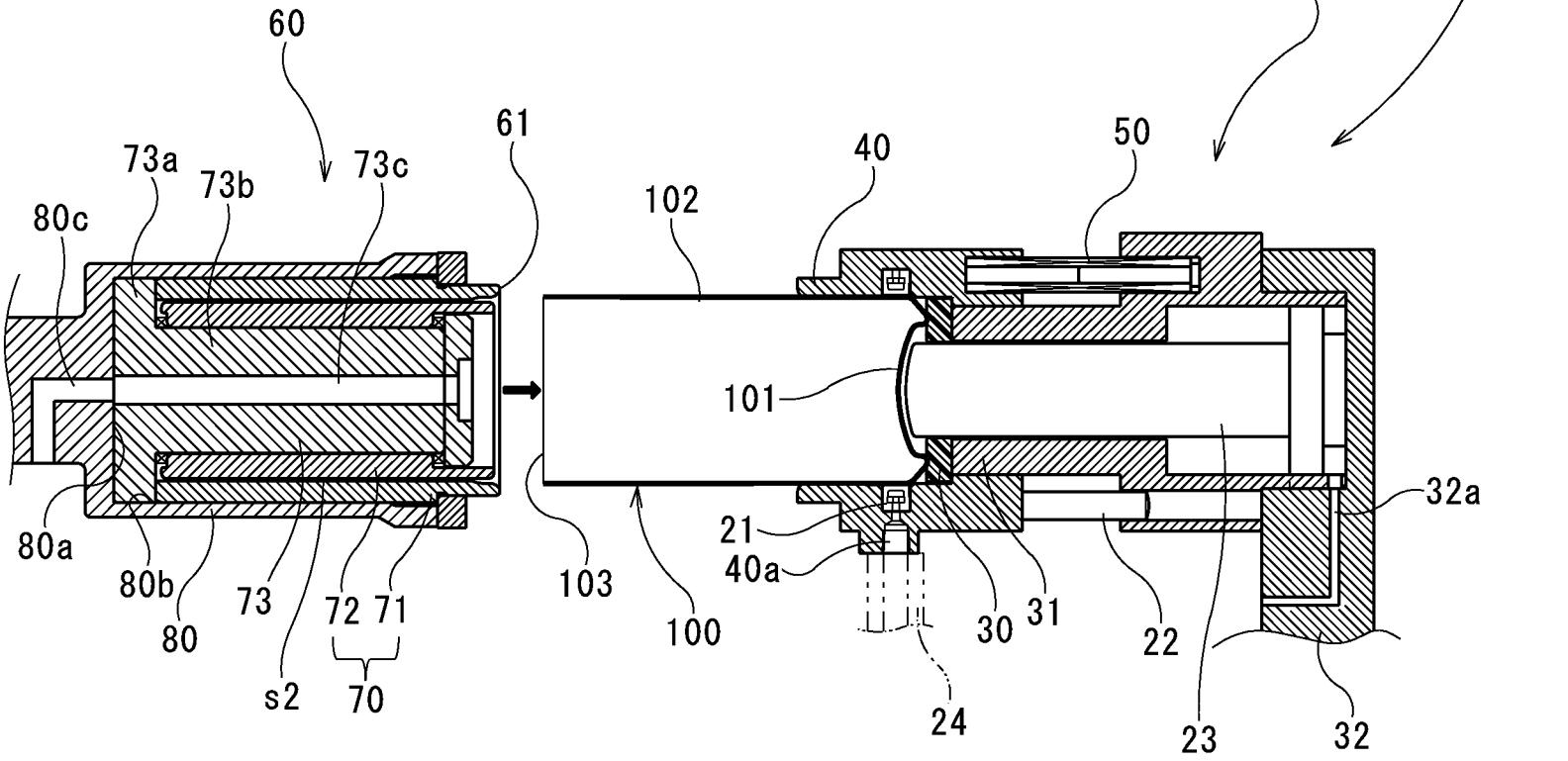
FIG. 1 It is a cross-sectional view showing a state in which a can-body before forming is held in a diameter-reduction apparatus for can-trunk provided with a can-body holder according to an embodiment of the present invention.

As shown in FIG. 1, the diameter-reduction apparatus 10 for can-trunk provided with the can-body holder 20 holding the can-body 100 and a die unit 60 for diameter-reduction having a die 70 performing diameter-reduction on the can-body 100. In this diameter-reduction apparatus 10 for can-trunk, the die 70 works in the trunk part 102 of the can-body 100 by moving the die unit 60 back and forth with respect to the can-body holder 20 along a can-axis direction.

The can-body holder 20 is provided with a base pad 30 abutting on a bottom part 101 of the can-body 100 and a first clamping-ring 40 having substantially a cylindrical shape which clamps an outer circumference surface of the trunk part 102 of the can-body 100 at the bottom part 101 side. The base pad 30 is formed annularly by elastic material such as rubber or the like, and held on a top surface of a base-pad holder 31 having substantially a cylindrical shape.

A back end of the base-pad holder 31 is fixed on a base-pad holder plate 32. A columnar cavity is formed in the base-pad holder 31. In the cavity, a plunger 23 is set so as to move back and forth by air introduced or evacuated through an air passage 32*a* formed in the base-pad holder plate 32.

The first clamping-ring 40 is formed substantially cylindrically so as to be inserted the can-body 100 therein; and a bottom part thereof is closed by the base pad 30 and the plunger 23 and an inner circumference surface thereof is fitted with an outer circumference surface of the base-pad holder 31, so that the first clamping-ring 40 can move relatively back and forth with respect to the base pad 30 along the can-axis direction. On the clamping ring 40, a spring (i.e., an elastic member or a returning device) 50 is provided so as to energize the first clamping-ring 40 and to advance with respect to the base pad 30. That is to say, the first clamping-ring 40 is fitted on the outer circumference surface of a cylindrical part of the base-pad holder 31 and is held by a guide pin 22, so as to move back and forth along the can-axis direction with being energized forward (i.e., a left side in the drawing) by the spring 50. In the diameter-reduction apparatus 10 for can-trunk, the base pad 30 and the base-pad holder 31 can be formed integrally.

On the first clamping-ring 40, an air-chucking unit 21 holding the can-body 100 with pressing is provided. The air-chucking unit 21 is expanded by air supplied from an air-supplying unit 24 which is provided so as to be connected to an air passage 40*a* radially penetrating the first clamping-ring 40. As a result, the air-chucking unit 21 protrudes from the inner circumference surface of the first clamping-ring 40 toward the can-axis so as to press the can-body 100 which is held in the first clamping-ring 40 from the outer circumference surface toward the can-axis, so that the can-body 100 can be held. In the air-chucking unit 21, the connection with the air supplying unit 24 is broken by retreat of the first clamping-ring 40, so that the pressure to the can-body 100 is released.

The die unit 60 opposite to the can-body holder 20 is provided so as to move back and forth with respect to the can-body holder 20, and has: the die 70 including an outer die 71 and an inner die 72 which are provided in a concentric double cylindrical state; a columnar core 73 which is fitted inside the die 70; and a closed-end cylindrical die holder 80 holding the die 70 and the core 73.

The core 73 has a flange part 73*a* which abuts on a bottom surface 80*a* of the die holder 80 and fits in an inner circumference surface 80*b* of the die holder 80. The core 73 is held in a state of being located so that an axis corresponds to that of the die holder 80 by titling the flange part 73*a* into the die holder 80. The flange part 73*a* and a columnar part 73*b* are provided coaxially with each other on the core 73. An air passage 73*c* is formed so as to penetrate the flange part 73*a* and the columnar part 73*b*. The air passage 73*c* opens at a top end surface of the columnar part 73*b* and is connected to an air passage 80*c* formed in the die holder 80, so that air is supplied from an external air-supplying device (not illustrated) and can flow in the air passage 73*c*.

The outer die 71 constructing the die 70 is held by being fitted to the inner circumference surface 80*b* of the die holder 80 and abutting on the flange part 73*a* of the core 73 in a positioning-state with respect to the die holder 80. The inner die 72 is held by being fitted to the columnar part 73*h* of the core 73 and abutting on the flange part 73*a* of the core 73 in a positioning-state with respect to the core 73.

Figure 2:
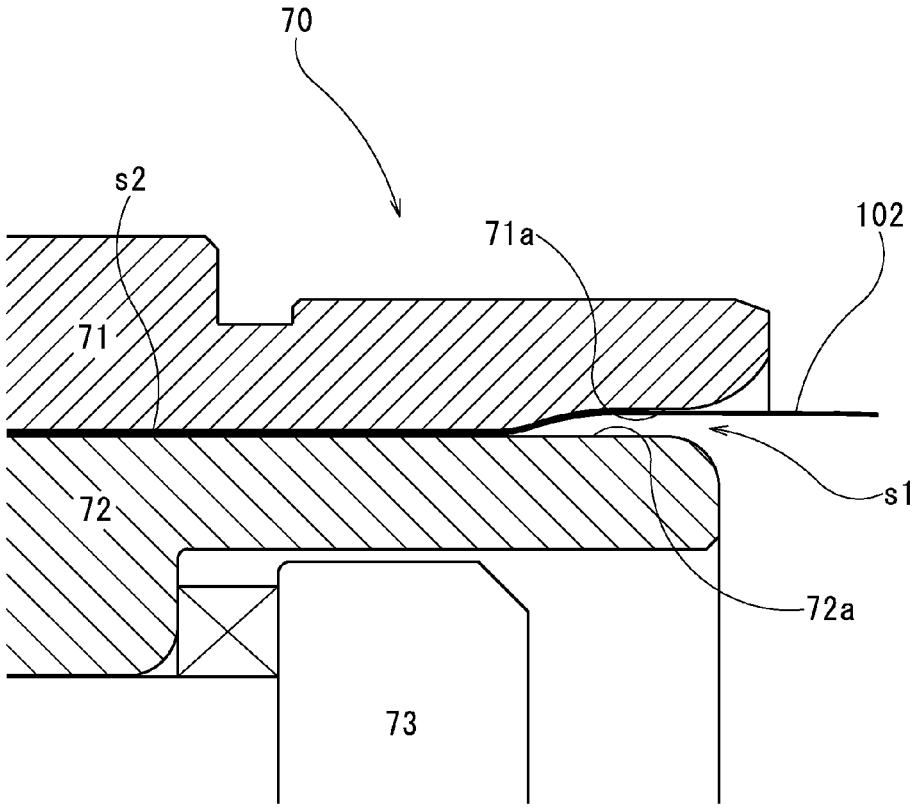
FIG. 2 It is a partial enlarged cross-sectional view showing a vicinity of a top end of a die in the diameter-reduction apparatus for can-trunk shown in FIG.

As shown in FIG. 2, an outer circumference surface 72*a* of the inner die 72 is formed straight extending along the can-axis direction. An inner circumference surface 71*a* of the outer die 71 which is fitted to an outer side of the inner die 72 is formed so as to have an inner diameter in which only an end thereof is large. Accordingly, between the inner circumference surface 71*a* of the outer die 71 and the outer circumference surface 72*a* of the inner die 72: a cylindrical introducing part s1 comparatively wide is formed at the end part; and a narrow cylindrical gap s2 is formed subsequently to the introducing part s1 at a most part except the end part. That is to say, in the die 70, a diameter of the trunk part 102 of the can-body 100 is reduced by being press-inserted through the introducing part s1 into the cylindrical gap s2 while being deformed so as to follow the inner circumference surface 71*a* of the outer die 71.

In the die unit 60, a contact part 61 is provided at the end of the outer die 71 so as to abut on the end of the first clamping-ring 40. When the die unit 60 is approached the can-body holder 20, the contact part 61 pushes the first clamping-ring 40 toward the bottom part 101 of the can body 100, so that the first clamping-ring 40 is retreated while advancing the end of the die 70 to the vicinity of the bottom part 101 of the can-body 100. As a result, the trunk part 102 of the can-body 100 can be formed by diameter-reduction to far as the vicinity of the bottom part 101.

It will be explained that the can-body 100 is formed by the can-body holder 20 and the die unit 60, referring the drawings. First, as shown in FIG. 1, in a state in which the can-body holder 20 and the die unit 60 are separated, while clamping the outer circumference surface of the trunk part 102 of the can-body 100 at the bottom part 101 side by using the first clamping-ring 40, the bottom part 101 of the can-body 100 is held on the can-body holder 20. The can-body 100 is positioned by a cylindrical inner surface of the first clamping-ring 40 and held by the air-chucking unit 21 pushing the vicinity of the bottom part 101 of the trunk part 102 of the can-body 100 by supply of the air through the air-supplying unit 24.

Next, while moving the first clamping-ring 40 backward, the die 70 performing the diameter-reduction of the trunk part 102 is advanced from an opening part 103 toward the bottom part 101 of the can-body 100 and press-inserted into the trunk part 102 of the can-body 100.

Figure 3:
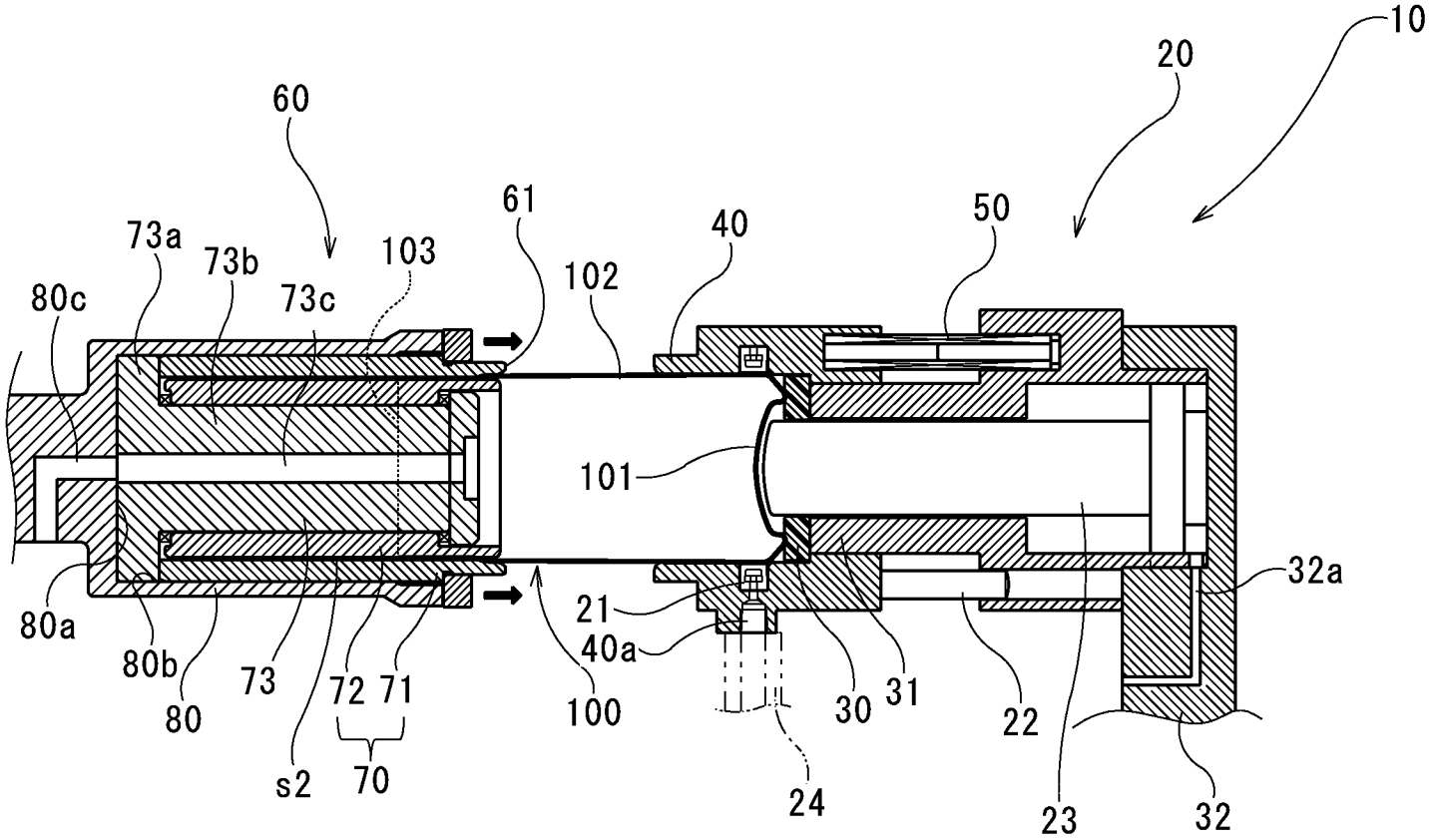
FIG. 3 It is a cross-sectional view showing a state in which an opening part of the can-body is pushed into the die by advance of a die unit in the diameter-reduction apparatus for can-trunk shown in FIG. 1.

That is to say, as shown in FIG. 3, by advancing the die unit 60 from the opening part 103 toward the bottom part 101 of the can-body 100 and press-inserting the trunk part 102 of the can-body 100 through the introducing part s1 into the cylindrical gap s2 between the outer die 71 and the inner die 72 of the die 70, the diameter-reduction is performed on the trunk part 102. At this time, air is supplied into the can-body 100 from an external air-supplying device (not illustrated) through the air passage 73*c* formed in the core 73 and the air passage 80*c* formed in the die holder 80, so that the inside of the can-body 100 is maintained at a positive pressure.

Figure 4:
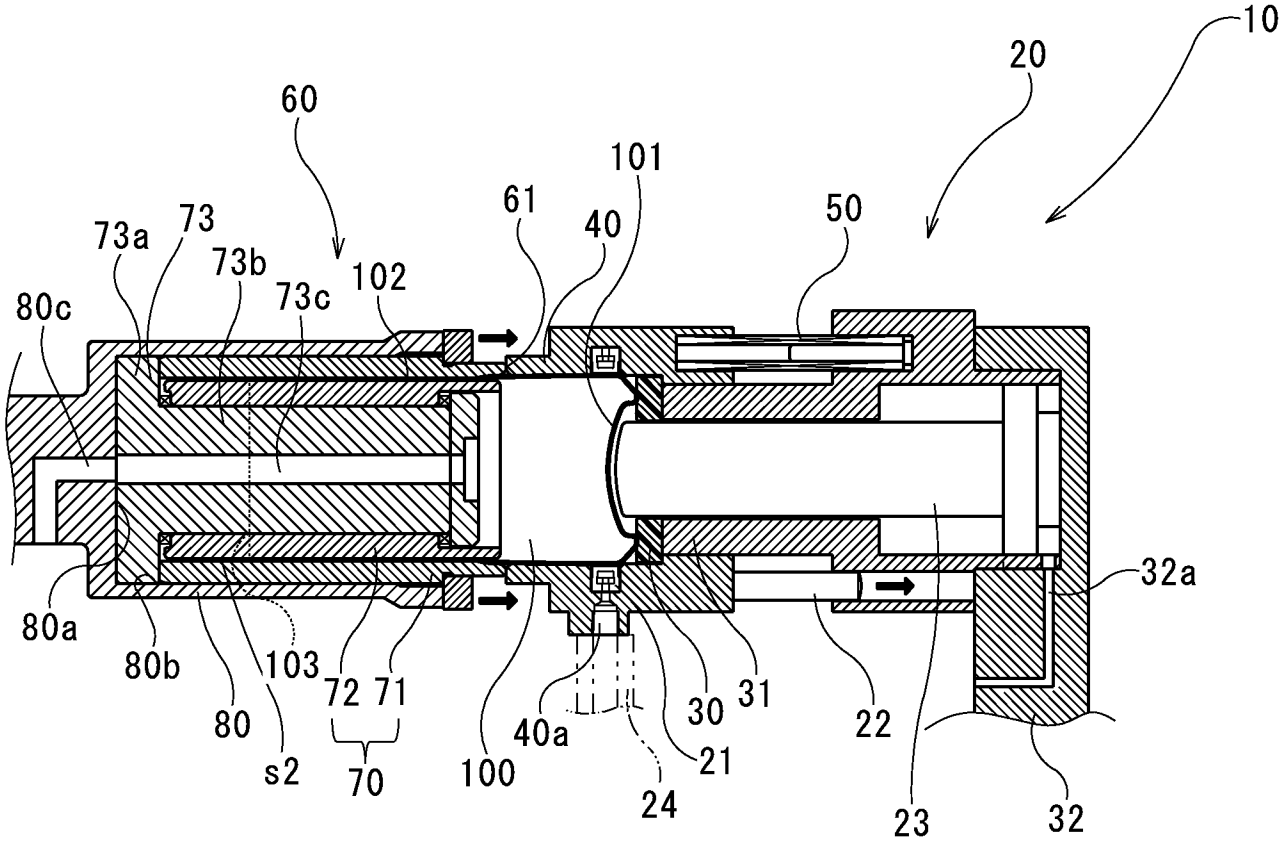
FIG. 4 It is a cross-sectional view showing a state in which a contact part is abutted on a top end of a first clamping-ring in the diameter-reduction apparatus for can-trunk shown in FIG. 1.
Figure 5:
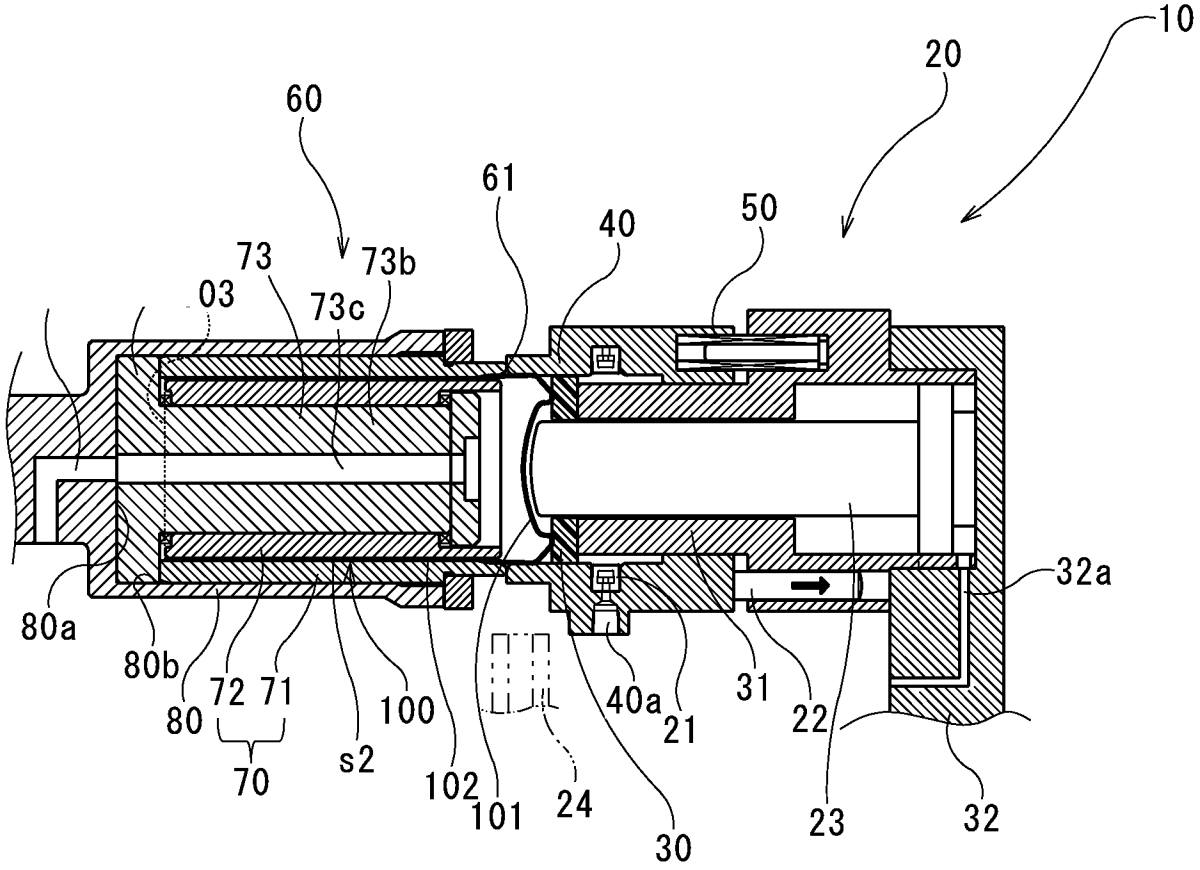
FIG. 5 it is a cross-sectional view showing a state in which the first clamping-ring is pushed back by the contact part and a trunk part of the can-body is formed up to a vicinity of a bottom part by the die in the diameter-reduction apparatus for can-trunk shown in FIG. 1.

Furthermore, the die 70 is advanced so that the diameter-reduction position is near the bottom part 101 of the can-body 100, so that the contact part 61 is abutted on the end of the first clamping-ring 40 (refer to FIG. 4), and then the first clamping-ring 40 is pushed backward (refer to FIG. 5). At this time, because the air-chucking unit 21 and the air-supplying unit 24 are disconnected by the retreat of the first clamping-ring 40, the pressure-holding by the air-chucking unit 21 is released, so that the first clamping-ring 40 is not prevented from moving. While the diameter-reduction is performed, the trunk part 102 of the can-body 100 is clamped by the first clamping-ring 40 at the outer circumference surface thereof, so that the deformation such as the swell out of the trunk part 102 and the like is prevented.

Figure 6:
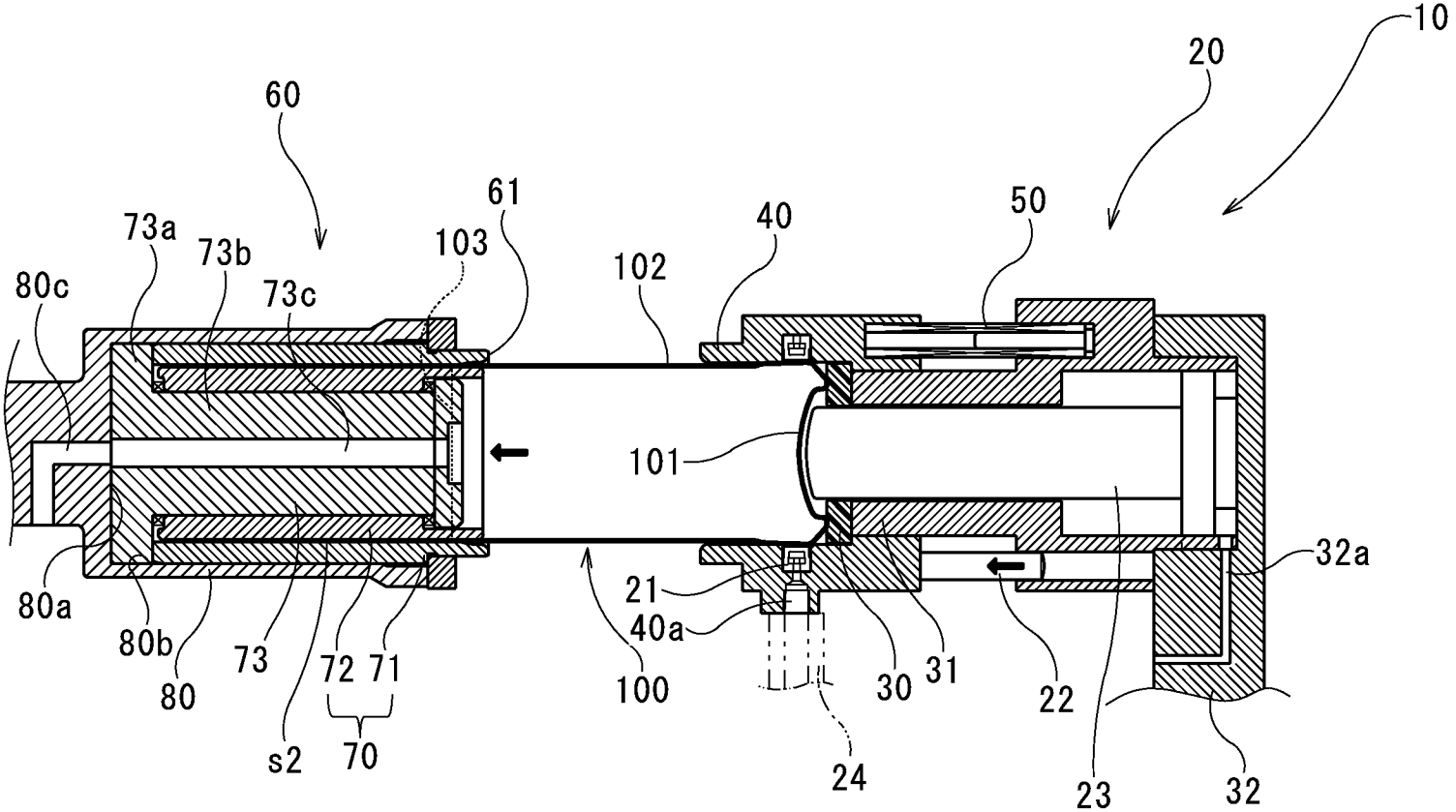
FIG. 6 It is a cross-sectional view showing a state in which the trunk part of the can-body is extracted from the die by retreat of the die unit and the first clamping-ring is advanced with being energized by an elastic member in the diameter-reduction apparatus for can-trunk show in FIG. 1.

After the diameter-reduction on the trunk part 102 to the vicinity of the bottom part 101 of the can-body 100 by press-inserting the die 70 into the trunk part 102 of the can-body 100 by advancing the die 70 while moving the first clamping-ring 40 backward, the die 70 is retreated as shown in FIG. 6. At this time, because the die 70 is retreated, the first clamping-ring 40 which is energized forward (i.e., toward the left in the drawing) by the spring 50 is advanced and returned to the previous position before the retreat, the air-chucking unit 21 is connected to the air-supplying unit 24, and it is possible to pressure-hold the can-body 100 by the air-chucking unit 21 again.

When the die 70 is retreated, because the inside of the can-body 100 is maintained at the positive pressure by the air supplied from the external air-supplying device (not illustrated) through the air passage 73*c* formed in the core 73 and the air passage 80*c* formed in the die holder 80, the die 70 is not retreated when holding the can-body 100, so that the can-body 100 is maintained as being held by the can-body holder 20.

Figure 7:
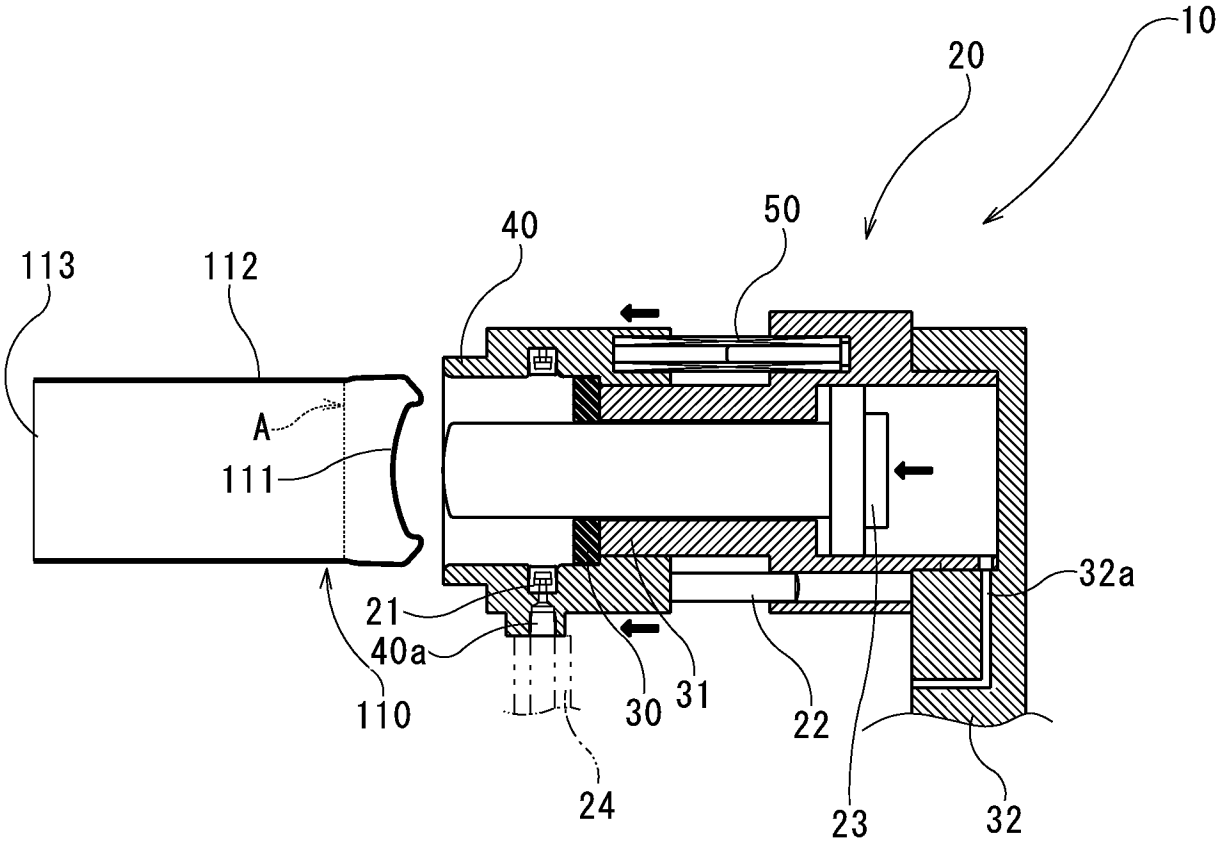
FIG. 7 It is a cross-sectional view showing a state in which the formed can-body is detached from a can-body holder in the diameter-reduction apparatus for can-trunk shown in FIG. 1.

Then, if the can-body 100 is dismounted at this time, after the die 70 is separated from the can-body 100, as shown in FIG. 7, the plunger 23 of the can-body holder 20 is advanced by supplying air through the air passage 32*a* of the base-pad holder plate 32 so that the bottom part 101 of the can-body 100 is pushed, and a can-body 110 in which the diameter-reduction is performed to a prescribed diameter-reduction position A is dismounted from the can-body holder 20.

As explained above, according to the diameter-reduction apparatus 10 for can-trunk of the present embodiment, because the first clamping-ring 40 clamps the outer circumference surface of the trunk part 102 at the vicinity of the bottom part 101 of the can-body 100, the swell of the trunk part 102 at the vicinity of the bottom part 101 while the diameter-reduction can be prevented. Moreover, because the first clamping-ring 40 can be retreated with respect to the can-body 100, the die 70 performing the diameter-reduction can be advanced to the vicinity of the bottom part 101 of the can-body 100. Accordingly, it is possible to form the can-body 110 in which the diameter thereof is reduced from an opening part 113 to the diameter-reduction position A in the vicinity of a bottom part 111.

Figure 8:
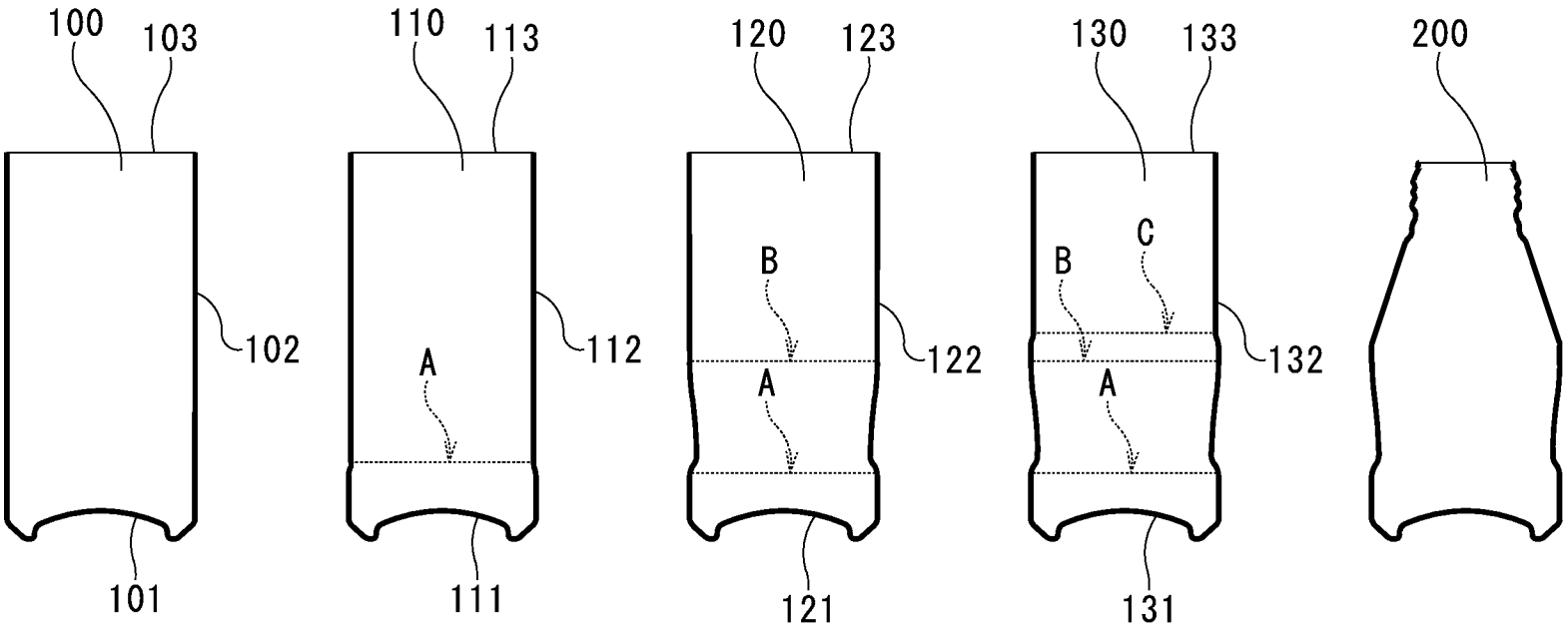
FIG. 8 It is across-sectional view showing shapes of bottle-cans in processes manufacturing by a diameter-reduction apparatus for can-trunk according to the present invention.
Figure 9:
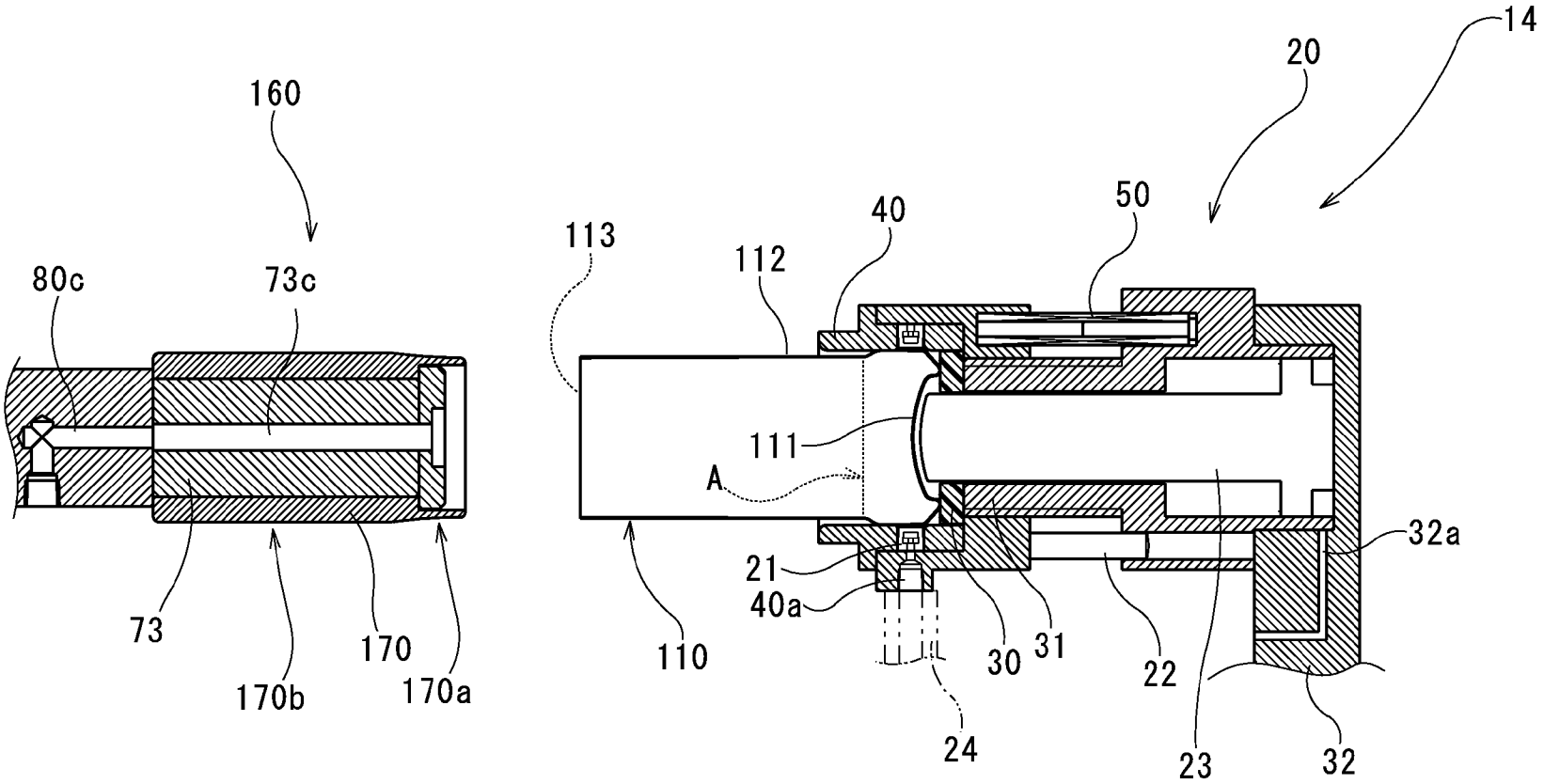
FIG. 9 It is a cross-sectional view showing a state in which a can-body is held before diameter-expansion in a diameter-expansion apparatus for expanding the diameter of the can-body.
Figure 10:
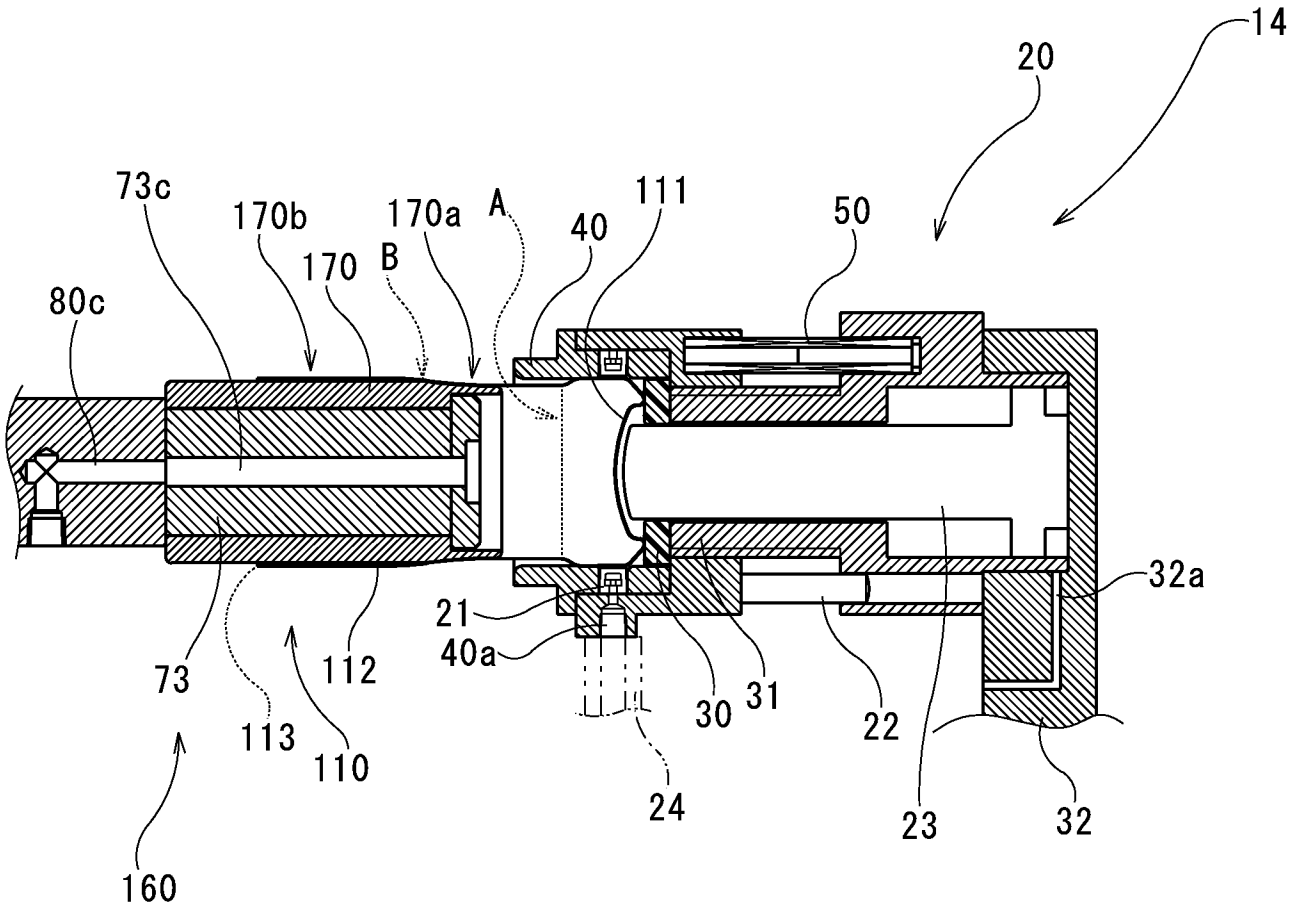
FIG. 10 It is a cross-sectional view showing a state in which a punch is pushed into the opening part of the can-body by advance of a die unit in the diameter-expansion apparatus for can-trunk shown in FIG. 9.

Next, with respect to the can-body 110 which is performed the diameter-reduction on as above, by using a diameter-expansion apparatus 14 for can-trunk shown in FIG. 9 and FIG. 10, a diameter-expansion is performed such as press-inserting a punch 170 having a larger external diameter than an inner diameter of the can-body 110 in the vicinity of the opening part 113, so that a can-body 120 which is performed the diameter-expansion from an opening part 123 to a prescribed diameter-expansion position B can be obtained (refer to FIG. 8). Because the diameter-expansion position B is nearer to the opening part 123 than the diameter-reduction position A, a trunk part 122 is constricted in the vicinity of a bottom part 121 in the can-body 120.

The diameter-expansion apparatus 14 for can-trunk performing the diameter-expansion with respect to the can-body 110 in which the diameter-reduction is performed on the opening part 113 side than the diameter-reduced position A will be explained, but the common members to that of the diameter-reduction apparatus 10 for can-trunk are denoted by the same reference symbols in FIG. 9 and FIG. 10 and the explanation thereof are omitted. The diameter-expansion apparatus 14 for can-trunk is, as similar to the diameter-reduction apparatus 10 for can-trunk, provided with: a can-body holder 20 holding the can-body 110; and a die unit 160 for diameter-expansion having the punch 170 performing the diameter-expansion on the can-body 110. In the die unit 160, an outer die fitting an outer circumference surface of the trunk part 112 of the can-body 110 is not provided, but the punch 170 which is press-inserted into an inner circumference surface of the trunk part 112 is provided.

In the diameter-expansion apparatus 14 for can-trunk, the punch 170 has: a tapered part 170*a* expanding from a small-diameter end (right end in the drawing) toward a base end side (left side in the drawing); and a large-diameter part 170*b* at the base end side of the tapered part 170*a*. A top end of the tapered part 170*a* is easily inserted into the can-body 110 because an outer diameter thereof is smaller than the opening part 113 of the can-body 110. Furthermore, an outer diameter of the large-diameter part 170*b* is larger than the trunk part 112 of the can-body 110, so it is possible to expand the trunk part 112 of the can-body 110 from the opening part 113 to the diameter-expansion position B by press-inserting the punch 170 into the can-body 110 from the opening part 113 until a right-end position of the large-diameter part 170*b* reaches the vicinity of the diameter-expansion position B (FIG. 10). As a result, the can-body 120 in which the trunk part 122 is constricted from the diameter-reduction position A to the diameter-expansion position B in the vicinity of the bottom part can be obtained (FIG. 8).

Figure 11:
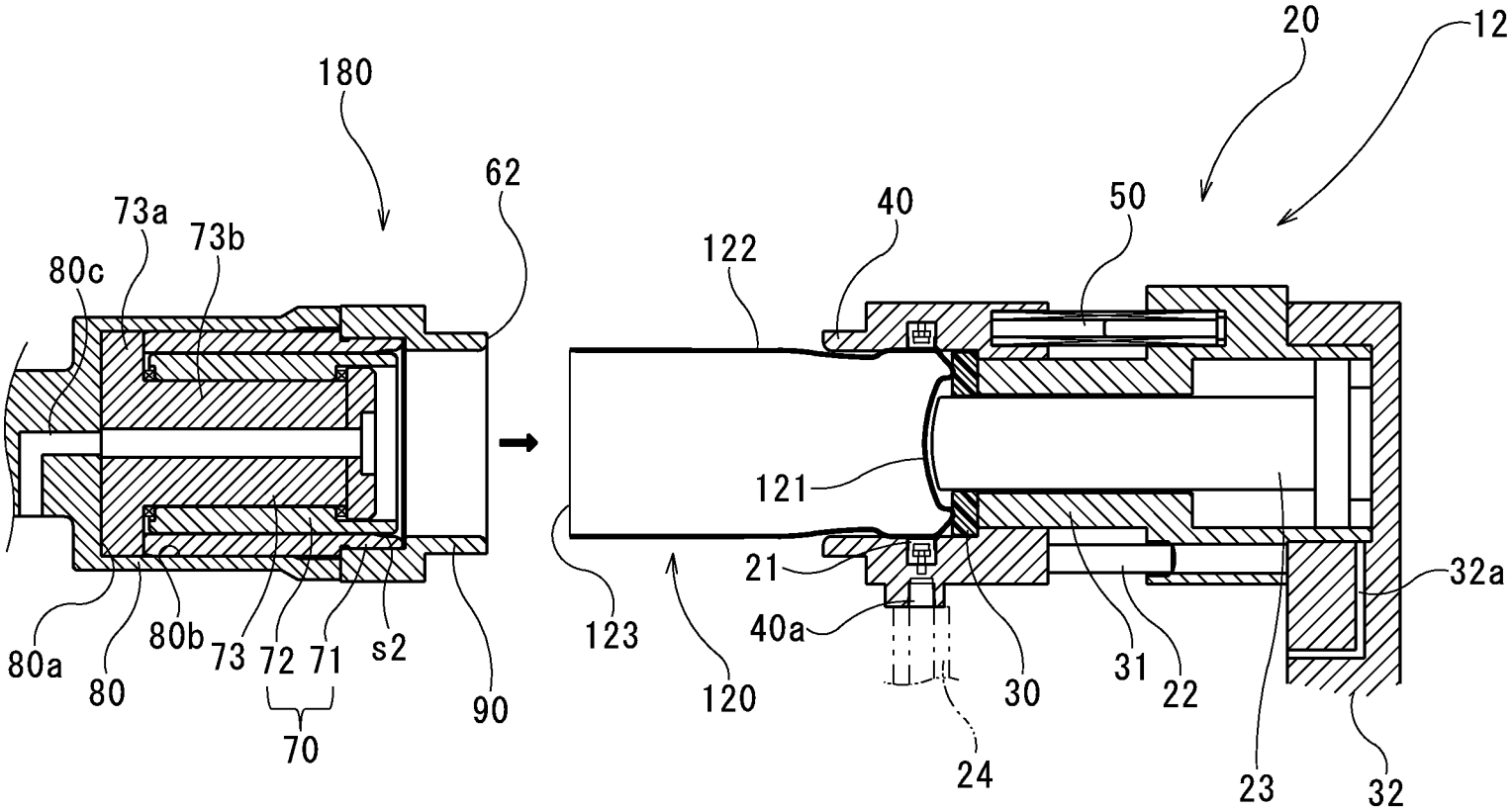
FIG. 11 It is a cross-sectional view showing a state in which a can-body before forming is held in a diameter-reduction apparatus for can-trunk provided with a second clamping-ring according to an embodiment of the present invention.

Next, with respect to the can-body 120 in which the diameter-reduction and the diameter-expansion are performed as above, by using a diameter-reduction apparatus 12 for can-trunk according to the embodiment of the present invention, as shown in FIG. 11, the diameter-reduction can be performed on the opening part 123 side than the diameter-expansion position B. The diameter-reduction apparatus 12 for can-trunk is provided with the can-body holder 20 having the first clamping-ring 40 and holding the can-body 120, and a die unit 180 for the diameter-reduction having a die 70 performing the diameter-reduction on the can-body 120 as similar to the diameter-reduction apparatus 10 for can-trunk: however, it is different from the diameter-reduction apparatus 10 for can-trunk because the die unit 180 further has a second clamping-ring 90. Below, the diameter-reduction apparatus 12 will be explained, but the common members to that of the diameter-reduction apparatus 10 for can-trunk are denoted by the same reference symbols and the explanation thereof are omitted.

In the diameter-reduction apparatus 12 for can-trunk, substantially the cylindrical second clamping-ring 90 provided at the die unit 180 protrudes forward (i.e., to right in the drawing) from the die 70 toward the can-body holder 20 so as to clamp the outer circumference surface of the trunk part 122 at the opening part 123 side. A contacting part 62 in the diameter-reduction apparatus 12 for can-trunk is an end of the second clamping-ring 90 and disposed so as to abut on the end of the first clamping-ring 40.

When the diameter-reduction is performed on a part comparatively near the opening part 123 of the trunk part 122, if using the diameter-reduction apparatus 10 for can-trunk, the die 70 is not advanced until the contacting part 61 abuts on the first clamping-ring 40. Accordingly, the can-body 120 is worked in a state in which a part of the outer circumference surface of the trunk part 122 is not clamped, so that the deformation such as the swell out of the trunk part 122 may be occurred. Therefore, it is conceivable that a length of the first clamping-ring 40 along the can-axis direction is prolonged; however, it may be difficult to mount the can-body 120 on the can-body holder 20.

Figure 12:
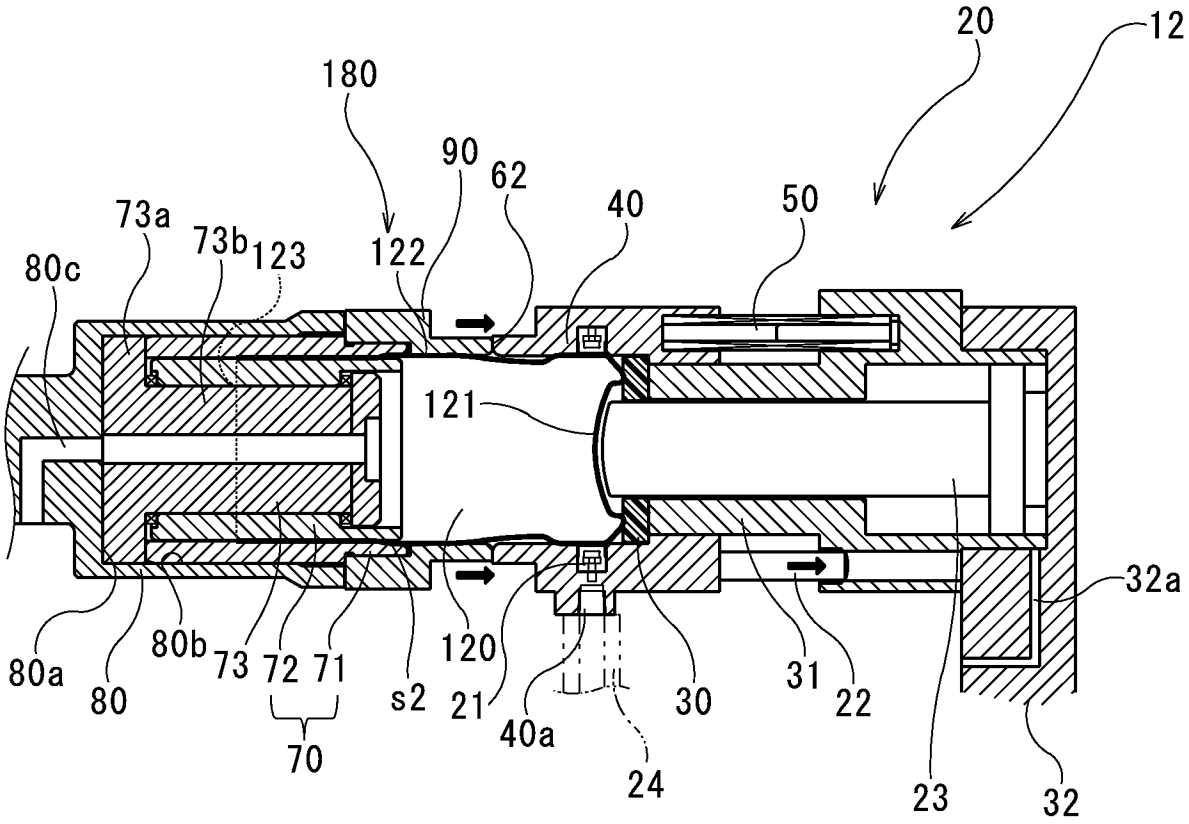
FIG. 12 It is a cross-sectional view showing a state in which an opening part of the can-body is pushed into a die by advance of a die unit and a contact part of the second clamping-ring is abutted on a top end of a first clamping-ring in the diameter-reduction apparatus for can-trunk shown in FIG. 11.
Figure 13:
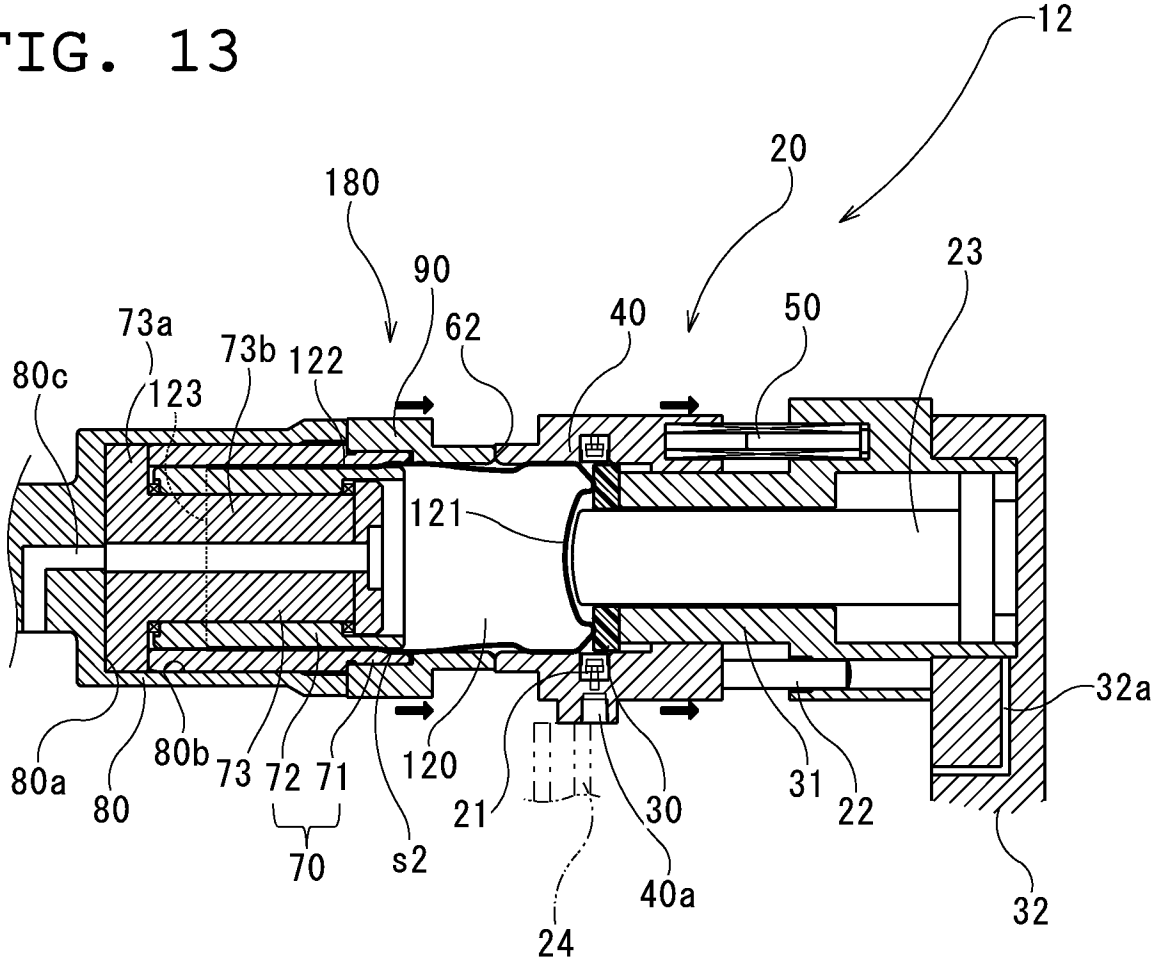
FIG. 13 It is a cross-sectional view showing a state in which the first clamping-ring is pushed back by the contact part and a trunk part of the can-body is formed up to a prescribed position from the opening part by the die in the diameter-reduction apparatus for can-trunk shown in FIG. 11.

On the other hand, in the diameter-reduction apparatus 12 for can-trunk, the length of the first clamping-ring 40 is not changed but the second clamping-ring 90 is attached to the die holder 80 so as to protrude forward from the die 70, so that it is possible to perform the diameter-reduction in a state in which the second clamping-ring 90 clamps the outer circumference surface of the trunk part 122 of the can-body 120. Furthermore, when the die unit 180 is advanced, the end of the second clamping-ring 90 abuts on the end of the first clamping-ring 40 (FIG. 12), and pushes back the first clamping-ring 40 (FIG. 13). Accordingly, a can-body 130 in which the trunk part 122 is constricted to a prescribed diameter-reduction position C while clamping a whole outer circumference surface of the trunk part 122 of the can body 120 can be obtained (refer to FIG. 8).

Figure 14:
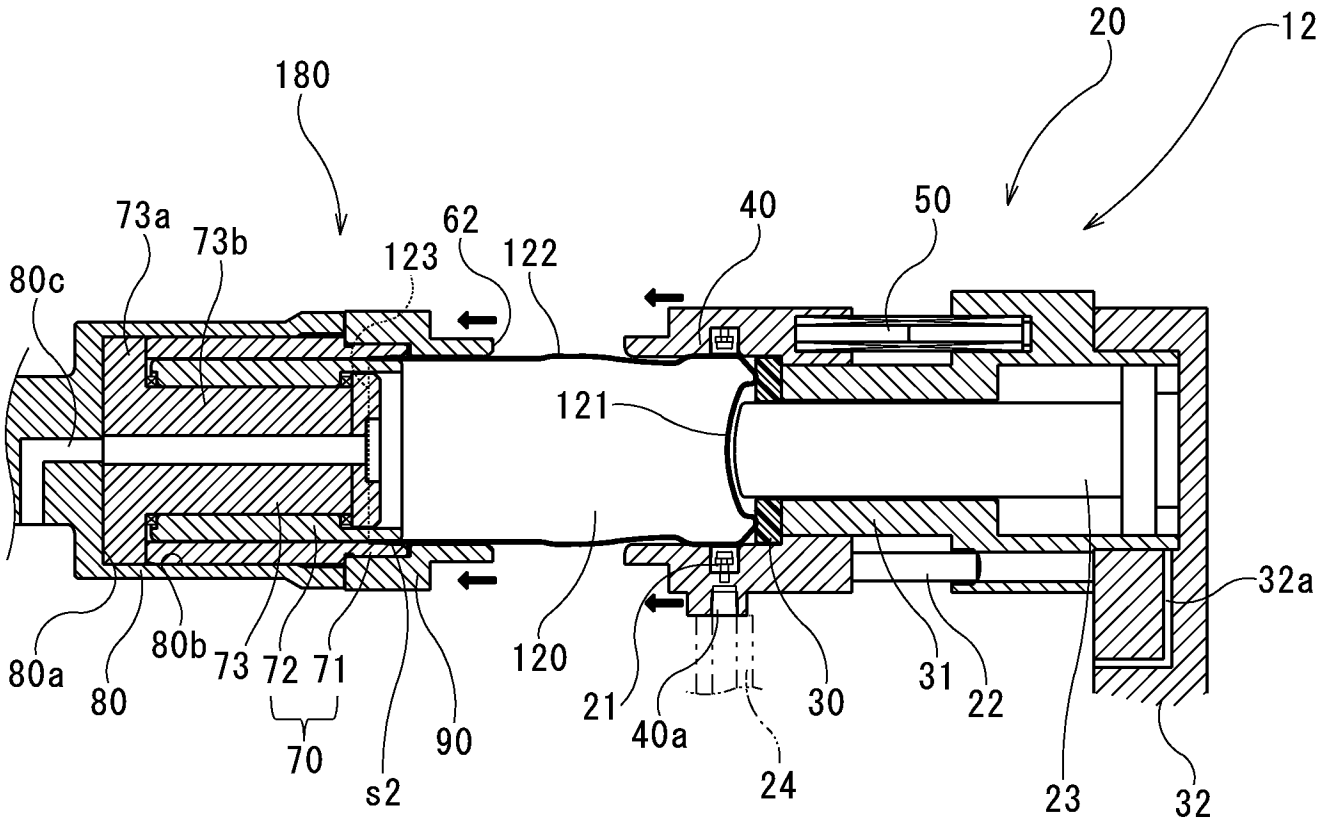
FIG. 14 It is a cross-sectional view showing a state in which the die unit is retreated and the first clamping-ring is advanced with being energized by an elastic member in the Jo diameter-reduction apparatus for can-trunk shown in FIG. 11.
Figure 15:
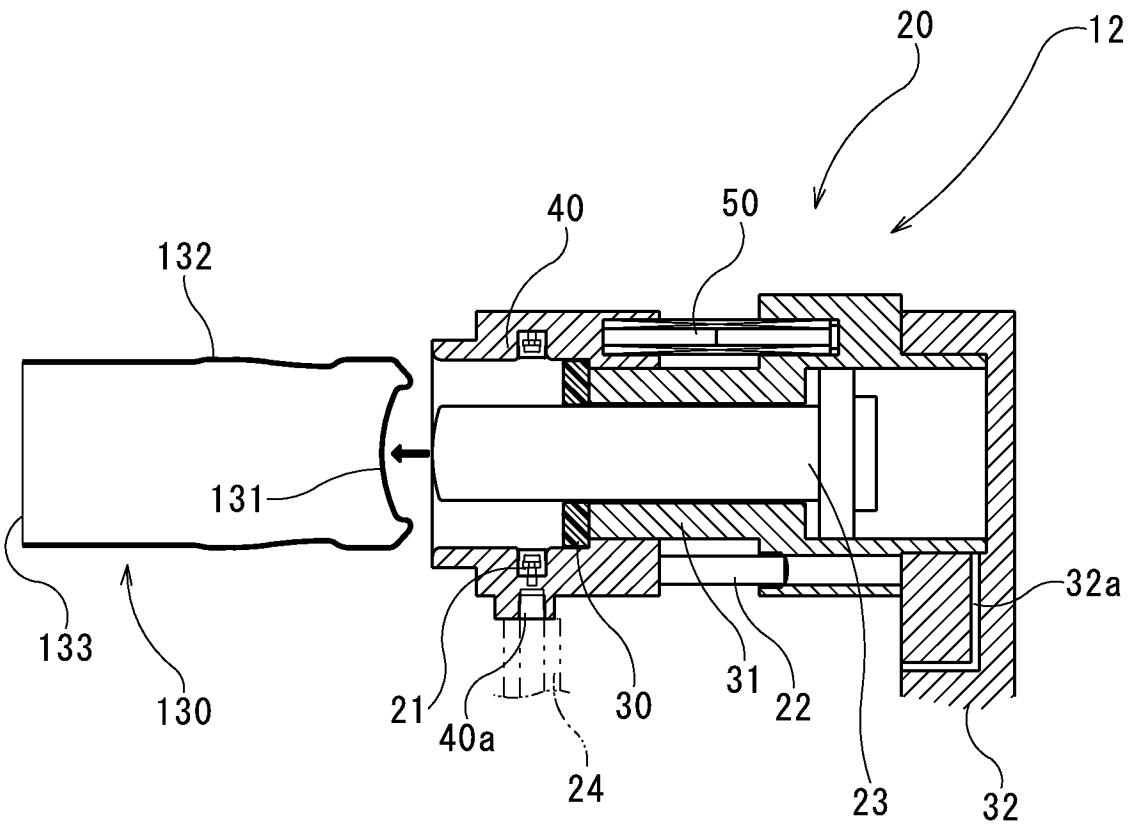
FIG. 15 It is a cross-sectional view showing a state in which the formed can-body is detached from a can-body holder in the diameter-reduction apparatus for can-trunk shown in FIG. 11.

After the diameter-reduction by advancing the die 70 to the prescribed position, the die 70 is retreated (FIG. 14), the plunger 23 is advanced so as to push a bottom part 131 of the can-body 130, so that the can-body 130 in which a trunk part 132 is constricted by the diameter-reduction from an opening part 133 to the diameter-reduction position C can be dismounted from the can-body holder 20 (FIG. 15). By further process for the can-body 130, a variant bottle-can 200 having a shape in which the vicinity of a bottom part is constricted as shown in FIG. 8 can be obtained.

As explained above, according to the diameter-reduction apparatus 12 for can-trunk of the present embodiment, because the outer circumference surface of the trunk part 122 in the vicinity of the bottom part 121 of the can-body 120 is clamped by the first clamping-ring 40, the trunk part 122 from the bottom part 121 to the vicinity of the diameter-expansion position B is prevented from swelling by the diameter-reduction. Therefore, elastic deformation of the bottom part 121 and the trunk part 122 at the diameter-reduction position A and the diameter-expansion position B by the diameter-reduction can be prevented, and a thickness of the can-body 120 can be prevented from being uneven caused by anisotropic of rolled material.

Since the second clamping-ring 90 is disposed in the vicinity of the die 70, the trunk part 122 can be effectively prevented from swelling and the like even though deformation by the die 70 is comparatively large. Moreover, after the die unit 60 is retreated, the first clamping-ring 40 retreated by being pushed by the contacting part 62 of the die unit 60 while forming the can-body 120 is advanced by the spring 50 and can be returned to a previous position.

A can-manufacturing apparatus 300 having the diameter-reduction apparatuses 10 and 12 for can-trunk, the diameter-expansion apparatus 14 for can-trunk and the can-body holder 20 will be explained. The can-manufacturing apparatus 300 according to an embodiment of the present invention is provided with: a plurality of the can-body holders 20; at least one processing-die unit 322 which forms a trunk part of a can-body (i.e., a work W) having a closed-end cylindrical shape by advancing and retreating along the can-axis direction with respect to the can-body holder 20; and a can-body holder moving device (i.e., a driving unit) 330 which moves the can-body holder 20 intermittently with respect to the processing-die unit 322. At least one of the processing-die units 322 is a diameter-reduction die unit 60 or 180 which performs the diameter-reduction on the trunk part of the can-body.

Figure 16:
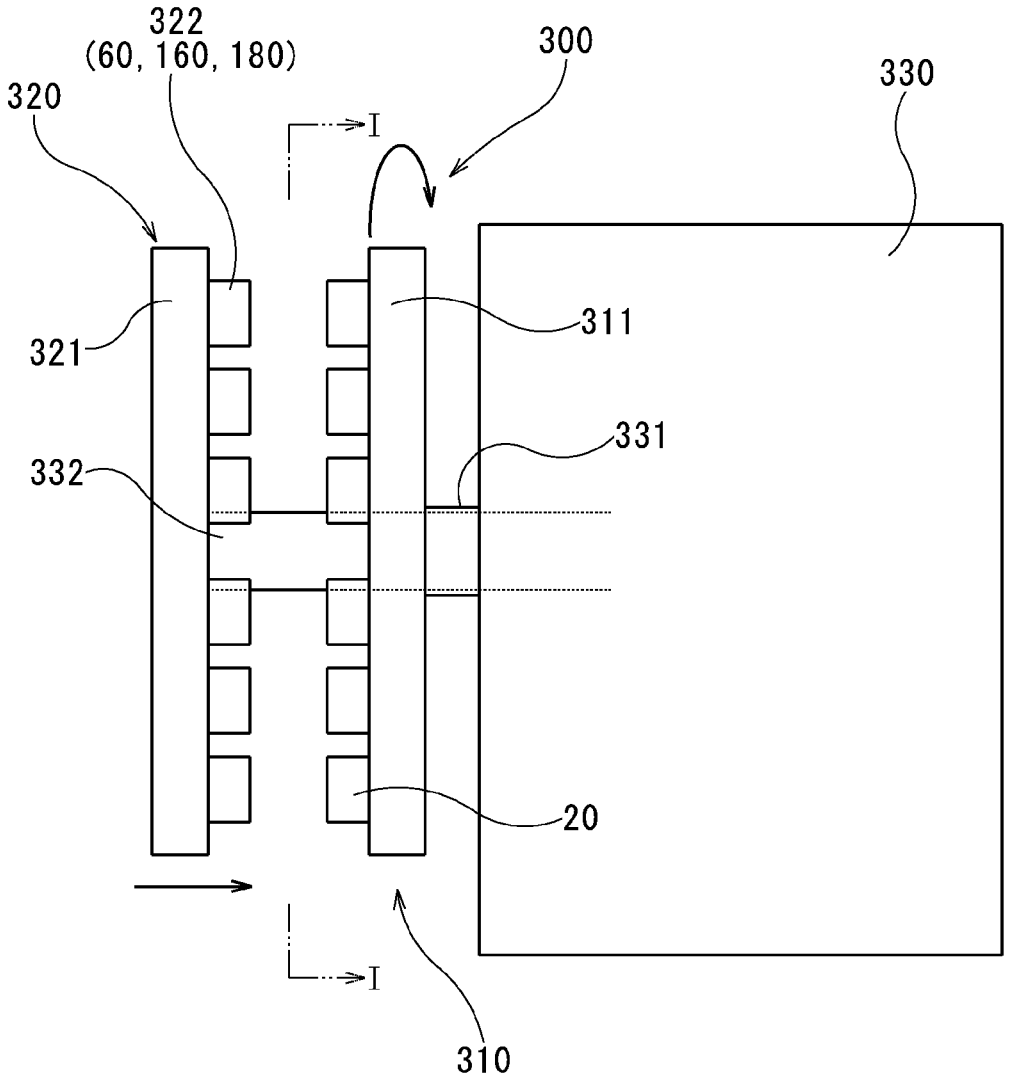
FIG. 16 It is a front view schematically showing a can-manufacturing apparatus provided with the diameter-reduction apparatus for can-trunk shown in FIG. 1.
Figure 17:
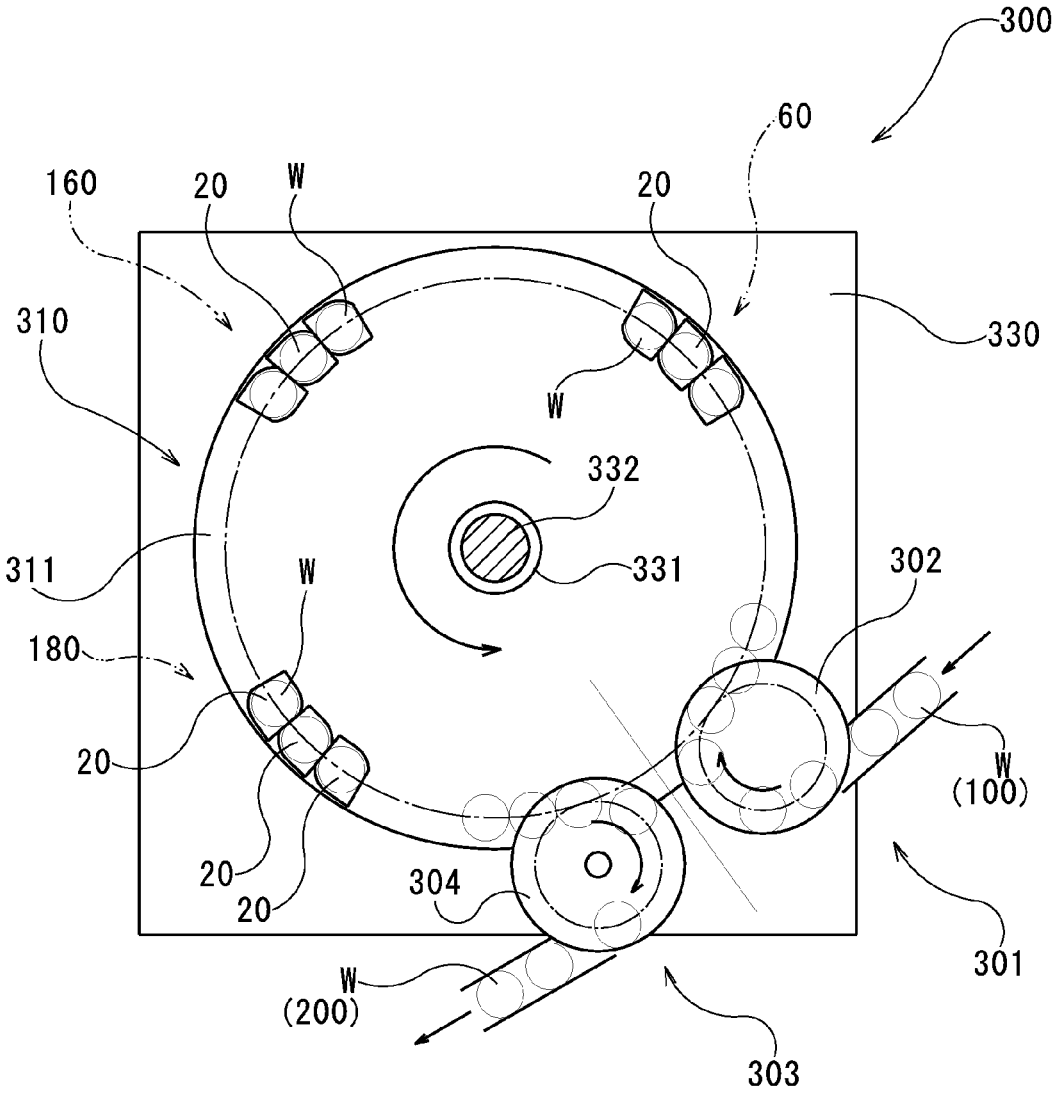
FIG. 17 It is a view taken along the line I-I in FIG. 16.

The can-manufacturing apparatus 300 is provided with, as shown in FIG. 16 and FIG. 17 more specifically, a work-holding unit 310 having a disk 311 in which the can-body holders 20 holding the works W are disposed circularly; a tool-holding unit 320 having a disk 321 in which the processing-die units 322 performing various processes on the works W are disposed circularly; and the driving unit 330 which drives the work-holding unit 310 and the tool-holding unit 320. In this can-manufacturing apparatus 300, as the processing-die units 322, the diameter-reduction die unit 60 of the diameter-reduction apparatus 10 for can-trunk, the diameter-expansion die unit 160 of the diameter-expansion apparatus 14 for can-trunk, the diameter-reduction die unit 180 of the diameter-reduction apparatus 12 for can-trunk and the like are provided.

The driving unit 330 has a supporting shaft 331 supporting the disk 311 of the work-holding unit 310 and a supporting shaft 332 supporting the disk 321 of the tool-holding unit 320 coaxially with each other. In the driving unit 330, the can-body holders 20 can be carried along a circumferential direction of the disk 311 by rotating the supporting shaft 331 intermittently. Moreover, by moving the supporting shaft 332 back and forth along the axis direction, the processing-die units 322 (the die units 60, 160, and 180) can be moved back and forth along the can-axis direction with respect to the can-body holders 20. The intermittent rotation of the supporting shaft 331 by the driving unit 330 is set so as to be stopped at a position in which each of the can-body holders 20 faces the processing-die units 322 respectively.

As shown in FIG. 17, in the can-manufacturing apparatus 300, to each of the can-body holders 20 of the work-holding unit 310, the closed-end cylindrical work W (the can-body 100) made by DI forming is supplied sequentially by a supplying star-wheel 302 of a work-supplying unit 301. The work W (the can-body 00 which is supplied is worked in various processes by the processing-die units 322 held by the tool-holding unit 320 while being carried by the work-holding unit 310 along the circumferential direction of the disk 311. The work W (the can-body 200) which is worked in various processes is extracted sequentially from the can-manufacturing apparatus 300 by an extracting star-wheel 304 at a work-extracting unit 303.

The work-holding unit 310 and the tool-holding unit 320 are disposed so that each of the can-body holders 20 and each of the processing-die units 322 face each other. Since the disk 311 holding the can-body holders 20 is rotated intermittently by the driving unit 330 via the supporting shaft 331, the processing-die units 322 facing the works W being held are alternated. Moreover, since the disk 321 is moved back and forth by the driving unit 330 via the supporting shaft 332, the processing-die units 322 are moved back and forth with respect to the work W along the can-axis direction, so that the works W are worked in the various processes.

In addition to the above die units 60, 160 and 180, the tool-holding unit 320 is provided with a plurality of the processing-die units 322 for working according to the work steps, such as a plurality of necking-dies for shoulder part for performing diameter-reduction on an opening part of the work W (a neck-in process), a thread-forming tool for a mouth section, a curl-forming tool and the like. Those processing-die units 322 are sequentially disposed circularly along the circumferential direction on the disk 321 in order of the processes.

The intermittent stop positions of the rotation of the work-holding unit 310 (the disk 311) around the axis of the supporting shaft 331 are set so that the can-axis of each of the works W in which the opening part thereof faces the tool-holding unit 320 and a center axis of each of the processing-die units 322 are coincided respectively. By the intermittent rotation of the disk 311 by the driving unit 330, each of the works W is carried rotationally to a position facing the processing-die unit 322 for a next process, and worked in the next process.

The can-body holder 20 has a structure moving back the first clamping-ring 40 clamping the outer circumference surface of the trunk part of the can-body at the bottom part side along the can-axis direction along with the advance of the processing-die unit 322, as described above. Accordingly, the works W can be held without preventing the process on the vicinity of the bottom part of the work by advance of the processing-die units 322.

That is to say, when the tool-holding unit 320 moves forward and approaches the work-holding unit 310, each of the processing-die units 322 works in the work W for each of the processes; and the work-holding units 310 is moved rotationally so that each of the works W faces the processing-die unit 322 of the next process in a state in which the holding units 310 and 40 are separated.

As explained above, the processes are performed when the holding units 310 and 40 are near to each other, and then, separated and rotated. By repeating those processes, the work W is worked in various forming processes, so that a can-body having a desired shape can be obtained.

The present invention is not limited to the above-described embodiments and various modifications may be made without departing from the scope of the present invention.

For example, when performing the diameter-reduction on a part near to the opening part of the can-body, that is, when the die is not advanced to the vicinity of the bottom part of the can-body, it is not necessary to move the first clamping-ring of the can-body holder back; and it is possible to perform the diameter-reduction by the first clamping-ring with preventing the part near to the bottom part from the elastic deformation such as the swell.

In the above embodiment, a first clamping-ring moving device is utilized so that the push-back device (the die 70 and the second clamping-ring 90) moves the first clamping-ring 40 of the can-body holder 20 backward along with the advance of the processing-die unit (the die units 60 and 160), and a returning device (the spring 50) returns the first clamping-ring 40 to the previous position along with the retreat of the die units 60 and 160. However, the first clamping-ring moving device is not limited to the structure pushing back by contact directly as the above embodiment.

Figure 18:
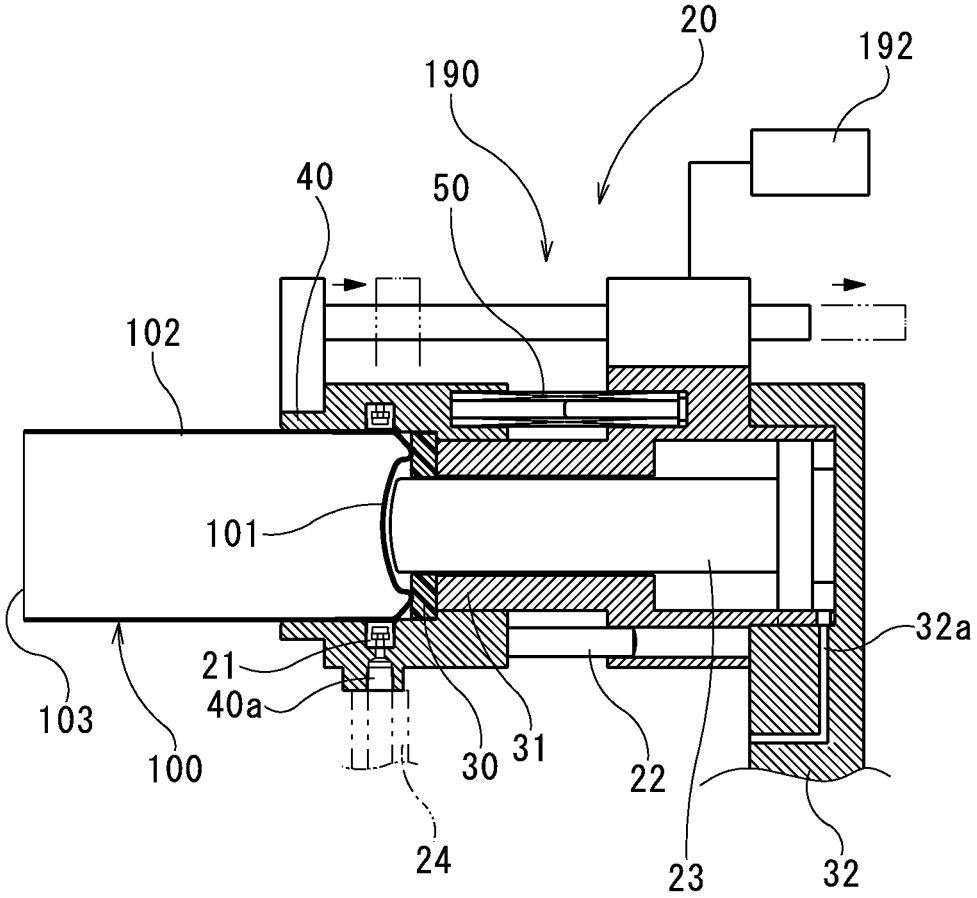
FIG. 18 It is a cross-sectional view showing another embodiment of a first clamping-ring moving device.

For example, as shown in FIG. 18, a structure may be adopted being provided with a drive unit 190 moving the first clamping-ring 40 back and forth such as an actuator, and a control device 192 controlling the drive device 190, in this case, the control device 192 can control the drive device 190 so as to drive the drive device 190 according to the back or forth position of the die units 60 and 180. Accordingly, parts can be prevented from being damaged owing to the contact between the first clamping-ring 40 and the die 70, for example.

INDUSTRIAL APPLICABILITY

It is possible to provide a variant-can having a narrow part in the vicinity of a bottom part by performing a diameter-reduction process up to the vicinity of the bottom part on a trunk part of a can body made of metal.

REFERENCE SIGNS LIST

10, 12 diameter-reduction apparatus for can-trunk
14 diameter-expansion apparatus for can-trunk
20 can-body holder
21 air-chucking unit
22 guide pin
23 plunger
24 air-supplying unit
30 base pad
31 base-pad holder
32 base-pad holder plate
32*a* air passage
40 first clamping-ring
40*a* air passage
50 spring (elastic member) (returning device)
60 (diameter-reduction) die unit (processing-die unit)
61, 62 contact part
70 die (push-back device)
71 outer die
71*a* inner circumference surface
72 inner die
72*a* outer circumference surface
73 core
73*a* flange part
73*b* columnar part
73*c* air passage
80 die holder

80*a* bottom surface
80*b* inner circumference surface
80*c* air passage
90 second clamping-ring (first clamping-ring moving device push-back device)
100, 110, 120, 130 can-body
101, 111, 121, 131 bottom part
102, 112, 122, 132 trunk part
103, 113, 123, 133 opening part
160 (diameter-expansion) die unit (processing-die unit)
170 punch
170*a* tapered part
170*b* large-diameter part
180 (diameter-reduction) die unit (processing-die unit)
190 drive device
192 control device
200 bottle-can
300 can-manufacturing apparatus
301 work-supplying unit
302 supplying star-wheel
303 work-extracting unit
304 extracting star-wheel
310 work-holding unit
311, 321 disk
320 tool-holding unit
322 processing-die unit
330 driving unit (can-body holder moving device)
331, 332 supporting shaft
s1 introducing part
s2 cylindrical gap
A, C diameter-reduction position
B diameter-expansion position
W work

The invention claimed is:

1. A diameter-reduction apparatus for can-trunk for performing a diameter-reduction process on a trunk part of a can-body having a closed-end cylindrical shape with an open end, comprising:

a can-body holder holding a bottom part of the can-body, which is provided with:

a base pad abutting on the bottom part of the can-body; and a first clamping-ring having substantially a cylindrical shape which clamps an outer circumference surface of a trunk part of the can-body at the bottom part side and which moves back and forth relative to the base pad along a can-axis direction;

a die unit for diameter-reduction provided with a die for a diameter-reduction process of the trunk part, the die moving back and forth with respect to the can-body holder along the can-axis direction; and a first clamping-ring moving device moving the first clamping-ring backward along the can-axis direction along with an advance of the die.

2. The diameter-reduction apparatus for can-trunk according to claim 1, wherein the first clamping-ring moving device comprises:

a push-back device moving back the first clamping-ring by pushing down the first clamping-ring along with approach of the die with respect to the can-body holder; and a returning device returning the first clamping-ring to a position before moving back.

3. The diameter-reduction apparatus for can-trunk according to claim 2, wherein the push-back device comprises a contact part which is provided on the die unit and abuts on a top end of the first clamping-ring.

4. The diameter-reduction apparatus for can-trunk according to claim 3, wherein:

the push-back device is a second clamping-ring which has substantially a cylindrical shape, is provided on the die unit, is protruded forward from the die toward the can-body holder, and clamps an outer circumference surface of the trunk part at an opening part side; and a top end of the second clamping-ring is the contact part which abuts on the top end of the first clamping-ring.

5. The diameter-reduction apparatus for can-trunk according to claim 2, wherein the returning device is an elastic member which is provided on the can-body holder and energizes the first clamping-ring toward the base pad.

6. The diameter-reduction apparatus for can-trunk according to claim 1, wherein the first clamping-ring moving device comprises:

a drive device which moves the first clamping-ring back and forth; and a control device which controls the drive device.

7. A can-manufacturing apparatus processing a can-body having a closed-end cylindrical shape in which one end is open, comprising:

a plurality of can-body holders each holding the can-body, and each comprising:

a base pad which abuts on a bottom part of the can-body; and a clamping ring having substantially a cylindrical shape, which clamps an outer circumference surface of the a trunk part at the bottom pat side of the can-body and moves back and forth relative to the base pad along a can-axis direction, the can-manufacturing apparatus further comprising:

at least one processing-die unit which forms a trunk part of the can-body by advancing and retreating along the can-axis direction with respect to the can-body holder; and a can-body holder moving device moving the plurality of can-body holders intermittently with respect to the processing-die unit, wherein one or more of the processing-die unit is a diameter-reduction die unit for diameter-reduction process of the trunk part of the can-body.

8. The can-manufacturing apparatus according to claim 7 wherein:

the at least one processing-die unit comprises processing-ie units, and at least one of the processing-die units is a diameter-expansion die unit which expands a diameter of the trunk part of the can-body.

* * * * *